US009067183B2

(12) United States Patent
Glanville

(10) Patent No.: US 9,067,183 B2
(45) Date of Patent: Jun. 30, 2015

(54) STATIC MIXER

(71) Applicant: Westfall Manufacturing Company, Bristol, RI (US)

(72) Inventor: Robert W. Glanville, Bristol, RI (US)

(73) Assignee: Westfall Manufacturing Company, Bristol, RI (US)

( * ) Notice: Subject to any disclaimer, the term of this patent is extended or adjusted under 35 U.S.C. 154(b) by 0 days.

(21) Appl. No.: 14/493,136

(22) Filed: Sep. 22, 2014

(65) Prior Publication Data

US 2015/0071028 A1 Mar. 12, 2015

Related U.S. Application Data

(63) Continuation-in-part of application No. 13/957,733, filed on Aug. 2, 2013, now abandoned.

(60) Provisional application No. 61/853,331, filed on Apr. 3, 2013.

(51) Int. Cl.

| | |
|---|---|
| ***B01F 5/06*** | (2006.01) |
| ***B01F 3/08*** | (2006.01) |
| *B01F 5/00* | (2006.01) |

(52) U.S. Cl.

CPC ..... *B01F 5/0605* (2013.01); *B01F 3/0865* (2013.01); *B01F 5/0057* (2013.01); *B01F 5/0654* (2013.01); *B01F 5/0617* (2013.01); *B01F 5/0652* (2013.01); *B01F 2005/0622* (2013.01); *B01F 2005/0636* (2013.01)

(58) Field of Classification Search

CPC ..... B01F 15/00915; B01F 2005/0636; B01F 2005/0622; B01F 5/0617; B01F 5/0616; B01F 5/0057; B01F 5/0619; B01F 5/0652; B01F 5/0654

USPC ..... 366/306, 307

See application file for complete search history.

(56) References Cited

U.S. PATENT DOCUMENTS

| | | | |
|---|---|---|---|
| 4,441,823 | A | 4/1984 | Power |
| 4,522,504 | A | 6/1985 | Greverath |
| 4,564,504 | A | 1/1986 | Sorber |
| 5,330,267 | A | 7/1994 | Tauscher |
| 5,597,236 | A | 1/1997 | Fasano |
| 5,810,052 | A | 9/1998 | Kozyuk |
| 5,839,828 | A | 11/1998 | Glanville |
| 6,604,850 | B1 | 8/2003 | Schneider et al. |
| 6,840,281 | B1 | 1/2005 | Amidzich |
| 6,997,214 | B2 | 2/2006 | Kuo |
| 8,147,124 | B1 | 4/2012 | Glanville |
| 8,240,135 | B2 | 8/2012 | Zhang |
| 8,322,381 | B1 | 12/2012 | Glanville et al. |

*Primary Examiner* — Tony G Soohoo

(74) *Attorney, Agent, or Firm* — Dingman, McInnes & McLane, LLP

(57) ABSTRACT

A static mixing device for use within an open channel includes a mixing section with at least one set of stationary mixing vane members and at least one conical section. In one example, the at least one conical section is an inlet section positioned upstream of the mixing section, while in another embodiment the at least one conical section includes both an inlet section positioned upstream and an outlet section positioned downstream of the mixing section. A plurality of vane members are also supported within the mixing section to promote fluid mixing. When used in an open channel, the static mixer having at least one conical section has a lower head loss in a shorter distance downstream from the mixing device than other conventional static mixers. In addition, the mixer is self-contained and is easy to mount, lightweight, and less expensive to manufacture and maintain than conventional open channel mixers.

23 Claims, 11 Drawing Sheets

FIG. 12

WESTFALL MANUFACTURING CO.

HEADLOSS CHART

*pipe ID* *12.00* *inches*

Pipe area 0.7854 ft2

MODEL 4000 CHANNEL MIXER

| GPM | CFS | ft/s | | psi Head loss |
|---|---|---|---|---|
| 353 | 0.785 | 1.00 | 0.039 | 0.02 |
| 705 | 1.571 | 2.00 | 0.155 | 0.07 |
| 1058 | 2.356 | 3.00 | 0.349 | 0.15 |
| 1410 | 3.142 | 4.00 | 0.621 | 0.27 |
| 1763 | 3.927 | 5.00 | 0.970 | 0.42 |
| 2115 | 4.712 | 6.00 | 1.398 | 0.61 |
| 2468 | 5.498 | 7.00 | 1.902 | 0.82 |
| 2820 | 6.283 | 8.00 | 2.484 | 1.08 |
| 3173 | 7.069 | 9.00 | 3.144 | 1.36 |
| 3525 | 7.854 | 10.00 | 3.882 | 1.68 |
| 3878 | 8.639 | 11.00 | 4.697 | 2.03 |
| 4230 | 9.425 | 12.00 | 5.590 | 2.42 |

pipe ID 305 mm

Pipe area 0.0730 m2

| m3/hr | m3/s | m/s | m head loss | kg/cm2 head loss |
|---|---|---|---|---|
| 80.1 | 0.0222 | 0.305 | 0.01 | 0.001 |
| 160.1 | 0.0445 | 0.610 | 0.05 | 0.005 |
| 240.2 | 0.0667 | 0.914 | 0.11 | 0.011 |
| 320.2 | 0.0890 | 1.219 | 0.19 | 0.019 |
| 400.3 | 0.1112 | 1.524 | 0.30 | 0.030 |
| 480.3 | 0.1334 | 1.829 | 0.43 | 0.043 |
| 560.4 | 0.1557 | 2.133 | 0.58 | 0.058 |
| 640.4 | 0.1779 | 2.438 | 0.76 | 0.076 |
| 720.5 | 0.2001 | 2.743 | 0.96 | 0.096 |
| 800.6 | 0.2224 | 3.048 | 1.18 | 0.118 |
| 880.6 | 0.2446 | 3.352 | 1.43 | 0.143 |
| 960.7 | 0.2669 | 3.657 | 1.71 | 0.170 |

*Graph A -Head Loss Chart*

| Mixer Velocity (ft/s) | Mixer 410 (inwc) | Mixer 310 (inwc) |
|---|---|---|
| 0 | 0.0 | 0.0 |
| 1 | 0.5 | 0.4 |
| 2 | 2.2 | 1.5 |
| 3 | 4.9 | 3.4 |
| 4 | 8.8 | 6.0 |
| 5 | 13.7 | 9.4 |
| 6 | 19.8 | 13.5 |
| 7 | 26.9 | 18.4 |
| 8 | 35.2 | 24.0 |
| 9 | 44.5 | 30.3 |
| 10 | 54.9 | 37.5 |

STATIC MIXER

CROSS-REFERENCE TO RELATED APPLICATIONS

This application claims priority to pending U.S. application Ser. No. 13/957,733, which claims priority to Provisional Application No. 61/853,331, filed Apr. 3, 2013, both of which are incorporated herein by reference in their entirety.

TECHNICAL FIELD

The present disclosure is directed to static mixers. More particularly, the present disclosure is directed to static mixers, which may be used in open channel applications.

BACKGROUND

Dynamic and static mixers are known in the art. Conventional dynamic mixers include two elements, which are rotatable relative to each other and include a flow path extending between an inlet for materials to be mixed and an outlet. Dynamic mixers use an electric motor to drive the rotatable elements, for example propellers, in order to mix fluid compositions. Such dynamic mixers can be expensive to purchase and maintain as they include electrically driven, moving parts and require large amounts of energy to operate.

In contrast, static mixers are widely available and do not include moving parts and do not require large amounts of energy to operate. Static mixers include fixed position structural elements that are generally mounted such that fluids passing through the elements may be effectively mixed or blended with a wide variety of additives. Such mixers have widespread use, such as in municipal and industrial water treatment, chemical blending and chlorination/de-chlorination facilities, to name but a few.

One type of static mixer is a pipe static mixer, where the structural elements are mounted within a conduit and the conduit is connected to a pipe system. As a result, such mixers are located within a closed environment. A highly effective, commercially available pipe static mixer is described in applicant's previous U.S. Pat. No. 5,839,828 issued Nov. 24, 1998 to Robert W. Glanville. The '828 patent discloses a device (10) having a circular flange (14) which is designed to be mounted internally within the pipe (24). The flange (14) includes a central opening which (22) having flaps (18) that extend radially inward within opening (22). The device when mounted within pipe (24) enables an effective mixing to be achieved downstream of the device. The teachings of U.S. Pat. No. 5,839,828 are hereby incorporated into the present specification in their entirety by specific reference thereto. An additional commercially available pipe static mixer is described in applicant's previous U.S. Pat. No. 8,147,124 issued Apr. 3, 2012 to Robert W. Glanville. The '124 patent discloses a static mixing device (10) for mounting within a hollow tubular conduit, the device including a plurality of vanes (14) generally equally spaced within the conduit, each vane including a generally oblong plate member (18) radially inwardly extending from the conduit internal wall surface (16) and having a generally wing-shaped cap (40) that downwardly, rearwardly and inwardly bends from the top of the plate to the internal conduit wall. The teachings of U.S. Pat. No. 8,147,124 are also hereby incorporated into the present specification in their entirety by specific reference thereto.

One application for static mixers is in open channels, such as water treatment channels for wastewater. In conventional open channel static mixers, the structural elements are mounted directly within an open channel and flow is directed through the mixers within the open channel. Typically, these structural elements are intended to be permanently mounted in the open channel and are typically large and heavy elements. As a result, installation and removal can be difficult and expensive, often requiring large equipment, such as cranes to install the elements.

SUMMARY

Unlike other applications, open channels can develop unusual velocity profiles not found in conventional piping systems. As such, reducing head loss in open channel static mixers is particularly desirable. There is a continued need in the art for open channel static mixers (i.e. without moving parts) that achieve the same or better mixing outcome as the devices described above, with low head loss in the shortest distance downstream from the mixing device. A need also exists for an open channel static mixer that is self-contained, easy to mount, lightweight, and less expensive to manufacture and maintain than available open channel mixers.

The present disclosure relates to a static mixing device that can be used with an open channel containing a moving fluid. The mixing device may preferably include at least one conical section that may be an inlet section or an outlet section, or a combination of the two, which is in fluid communication with a conduit or pipe section. In one example, both an inlet conical section and an outlet conical section are provided, with the inlet conical section and the outlet conical section having different angles, the inlet angle being larger than the outlet angle. In another embodiment, only an inlet conical section is provided. In yet another embodiment, an inlet conical section having multiple segments with non-uniform angles is provided.

Whether using one or two conical sections, the pipe or mixing section includes at least a first set of vane members supported therein. The mixing section may further include second and/or third sets of vane members also supported therein. The at least one conical section and the mixing section define a longitudinally extending flow path for the fluid. Each of the vane members extends radially inwardly from an internal wall surface of the mixing section towards the center of the mixing section and are selectively configured and positioned in order to promote mixing of fluids passing there through along the flow path.

Because the vane members are supported within the mixing section, the open-channel static mixer disclosed herein is self-contained, easy to mount, lightweight, and can be less expensive to manufacture and maintain than available open channel mixers. In addition, the static mixer has low head loss and can be adjusted to improve head loss for a desired application, for example by readily adapting the physical size of the static mixer.

BRIEF DESCRIPTION OF THE DRAWINGS

Various aspects of at least one embodiment are discussed below with reference to the accompanying figures, which are not intended to be drawn to scale. The figures are included to provide an illustration and a further understanding of the various aspects and embodiments, and are incorporated in and constitute a part of this specification, but are not intended as a definition of the limits of any particular embodiment. The drawings, together with the remainder of the specification, serve to explain principles and operations of the described and claimed aspects and embodiments. In the figures, each identical or nearly identical component that is illustrated in various figures is represented by a like numeral. For purposes of clarity, not every component may be labeled in every figure. In the figures:

FIG. 12 is a head loss chart showing the head loss of the exemplary static mixer of FIG. 10A.

DETAILED DESCRIPTION

Figure 1:
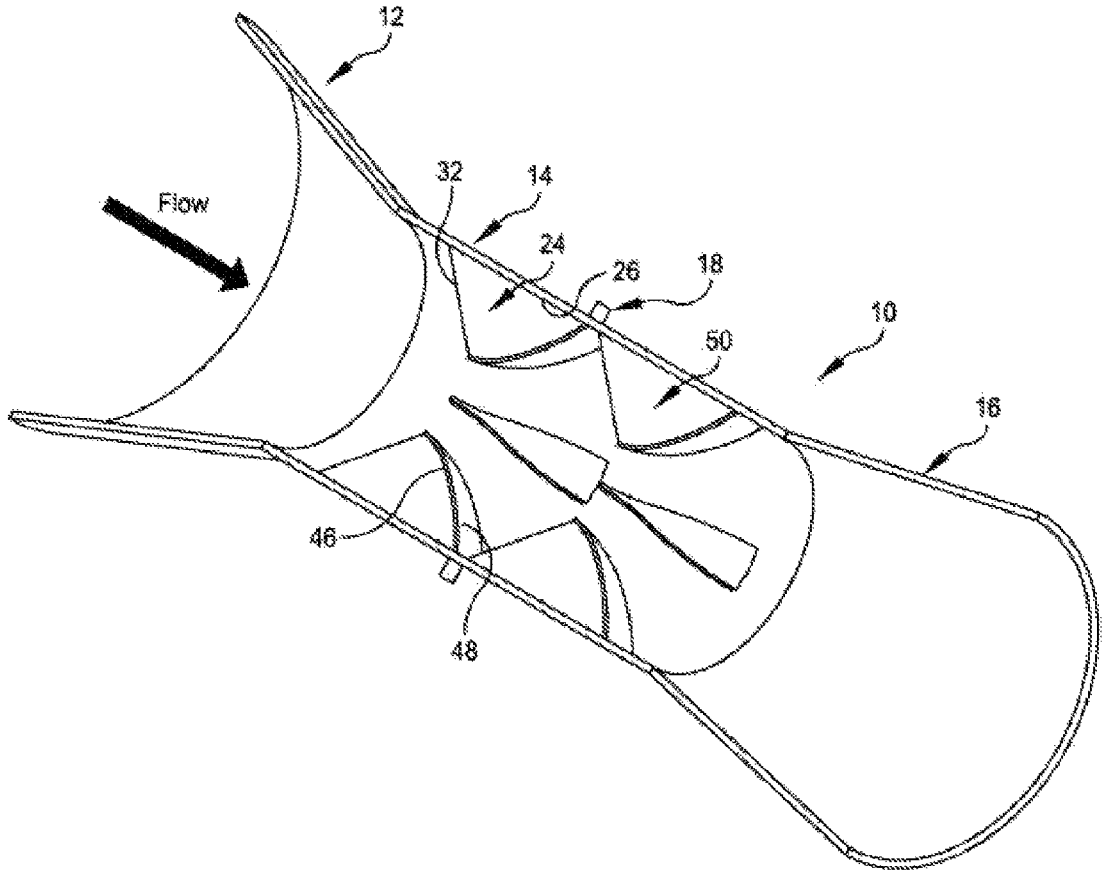
FIG. 1 is a partial, sectional, perspective view of a first exemplary static mixer having an inlet and outlet conical section and a mixing section.
Figure 2:
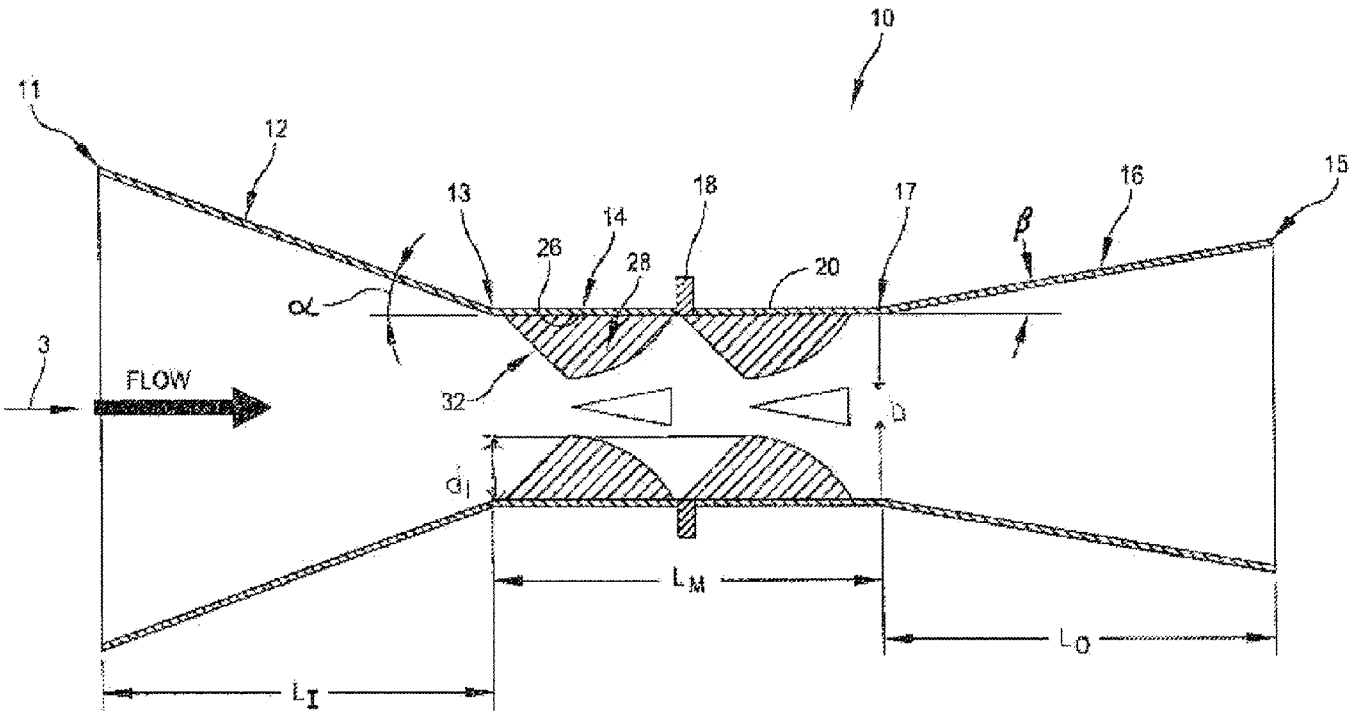
FIG. 2 is a cross-sectional view of the static mixer of FIG. 1.

Turning now to the drawings and particularly FIGS. 1 and 2, the construction of a first exemplary static mixing device 10 for open channel applications is shown. Although described as being used in connection with open channels, it is to be understood that the devices described herein might find use in other applications as well; particularly where improved mixing with low head loss in short distances is desired. As used herein, the term "head loss" refers to the reduction in the total head of a fluid caused by the friction present in the fluid's motion. Friction losses are dependent upon the viscosity of the liquid and the amount of turbulence in the flow. Whenever there is a change in the direction of flow or a change in the cross-sectional area a head loss will occur. In the present embodiment, mixing device 10 includes an inlet section 12 upstream of a pipe or mixing section 14, and may also include a diffuser or outlet section 16 downstream of mixing section 14.

In the present embodiment, inlet section 12 has the geometry of an inlet conical section with a tapered configuration that tapers or converges from a first or proximal inlet end 11 to a second or distal inlet end 13, where it forms an included angle $\alpha$ with mixing section 14. As illustrated, $\alpha$ is about 20° in the present embodiment, but may be readily varied depending upon the application, and may be, for example, between about 5°-50° for conventional wastewater open channel applications. Inlet conical section 12 is in fluid communication with mixing section 14 and directs the flow of fluid into the mixing section 14. Inlet conical section 12 has a length $L_I$ which may also be varied according to the application, and which is about 48 inches in the present embodiment. The tapered configuration and geometry of inlet conical section 12 aids in smoothing the flow of fluid entering the mixing section 14 which aids in reducing head loss. As such, inlet conical section 12 in combination with mixing section 14 has been found to provide good mixing while reducing head loss, as described in greater detail below. If a further reduction in head loss is desired, diffuser or outlet section 16 may be provided downstream of mixing section 14.

Outlet section 16 may likewise have the geometry of a conical section that diverges from a first or proximal outlet end 17 to a second or distal outlet end 15, forming an included angle $\beta$ that may be less than that of angle $\alpha$. In the present embodiment, angle $\beta$ is, for example, about 10°. Other angles may be utilized depending upon the application, for example, the angle for $\beta$ may be in the range of about 5°-40° in the present embodiment. Outlet section 16 may have length $L_O$ of, for example, about 48 inches. The conic section lengths $L_I$ and $L_O$ and geometry (angles $\alpha$ and $\beta$ may change to accommodate differing channel dimensions and flow rates. Outlet conical section 16 is in fluid communication with mixing section 14 and directs the flow of the fluid out of the mixing section 14, as illustrated. Outlet conical section 16 provides an additional reduction in head loss through mixing device 10 as it directing and smoothing flow of the fluid out of mixing section 14.

Mixing section 14 has a length $L_M$ which may also be configured and dimensioned according to the particular application and which is, for example, about 48 inches in the present embodiment. Mixing section 14 may include a circumferentially extending flange 18 on the exterior surface 20 thereof for mounting the mixer 10. The geometry of flange 18 can be changed depending upon the application in order to accommodate different mixer mounting systems, as would be known to those of skill in the art. For example, if the mixer is mounted through a round hole in a contractor installed concrete wall, then the mixer flange will be approximately 4" larger than the hole in the wall. However, if the mixer is mounted in steel channels (mounted on the walls of a concrete lined open channel by a contractor), then the mixer flange will be square to match the interior dimensions of the open channel. Thus the geometry and size of the flange will be varied according to the particular application.

Figure 3:
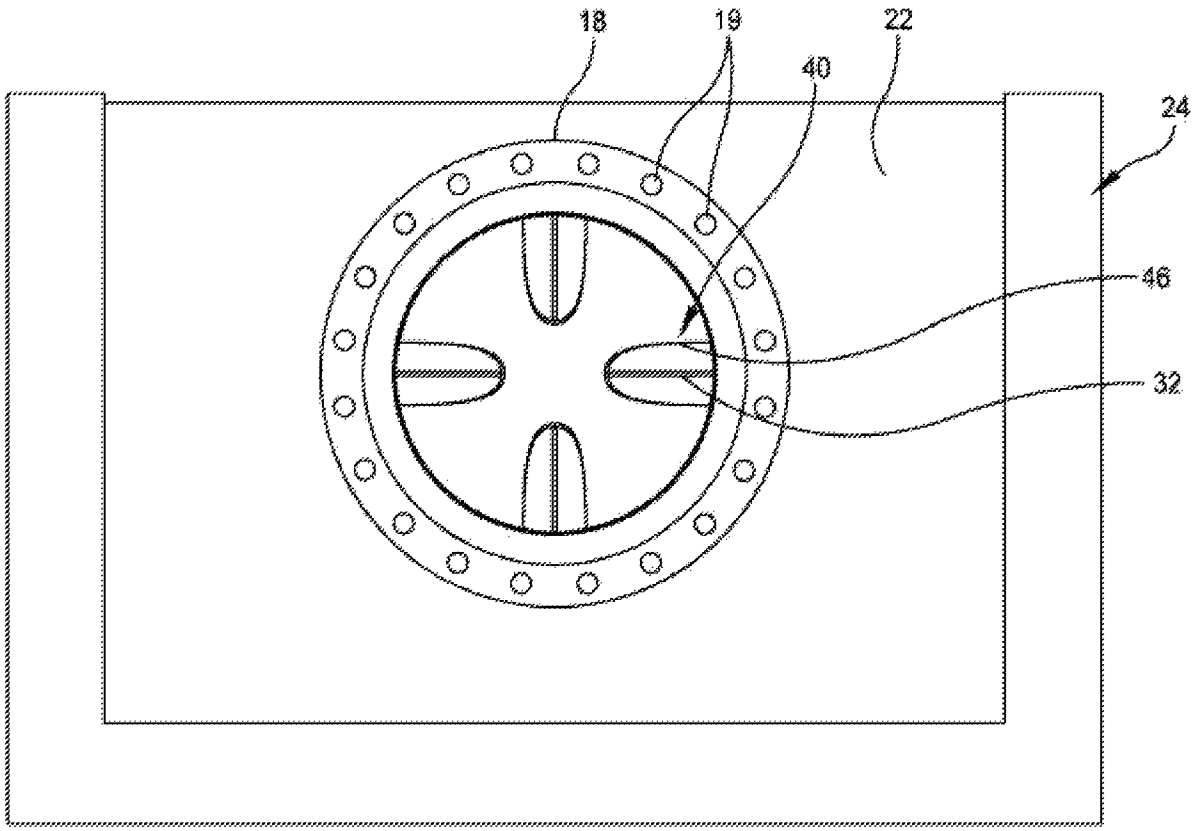
FIG. 3 is an end view of the static mixer of FIG. 2 along arrow 3, where the inlet conical section has been removed for clarity and the mixer is installed in an open channel.

Referring now to FIG. 3, flange 18 may be used to mount mixer 10 within a removable or permanent bulkhead 22 disposed in an open channel 24. Mixer 10 may, for example, be mounted approximately in the longitudinal centerline of channel 24. The inner diameter "D" of mixing section 14 is less than that of the cross-sectional area of the channel, up to about half of the cross-sectional area of channel 24 in the present embodiment. Channel 24 may be an open channel such as an irrigation channel, a channel for wastewater treatment, a channel for potable water treatment or the like. Such open channels may be used when adding various chemicals, as desired for the particular application, (for example Sodium Hypochlorite) to the fluid flowing there through.

Figure 4:
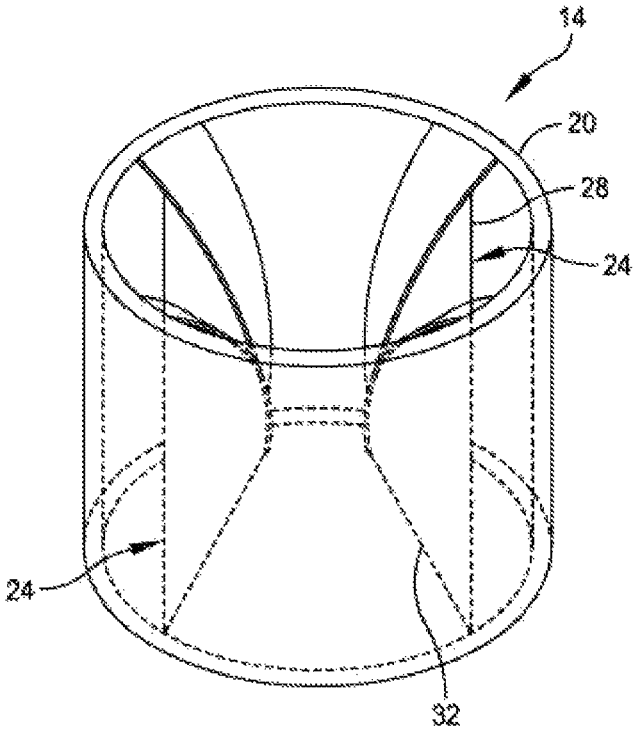
FIG. 4 is a perspective view of a portion of the mixing section shown in FIG. 1.
Figure 5:
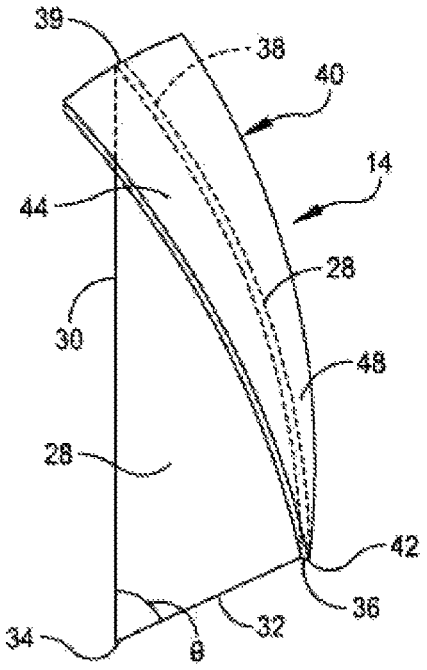
FIG. 5 is a perspective view of one of the individual mixing vanes that are internally disposed within the mixing section shown in FIG. 4.

With reference to FIGS. 2 and 3, mixing section 14 may further include a plurality of vane members 24. In the present embodiment, at least a first set of vane members 24 (generally two to four vane members 24 in a set) are provided spaced approximately circumferentially equidistant within mixing section 14, with each vane member 24 extending radially inwardly from an inner surface 26 of the mixing section 14 toward the center of the mixing section 14 (for a cylindrical mixing section the center running along the longitudinal axis, i.e. bisecting the cylindrical mixing section). In the present embodiment, each vane member 24 extends radially inwardly to a distance approximately one-third "$d_1$" of the inner diameter "D" of the mixing section 14. As will be appreciated, larger mixing sections 14 could have larger sized vane members and smaller mixing sections could have smaller sized vane members, although the distance the vane members extended radially inwardly as a function of the diameter could preferably remain the same, as desired. Additional sets of vane members may also be provided, depending upon the length of the mixing section, as desired. Referring to FIGS. 4 and 5, vane members 24 each include plate member 28 of planar extent with a substantially straight base edge 30 that is secured the inner surface 26 (see FIG. 2) for example by welding, adhesive or being otherwise attached depending on the type material from which mixer 10 is constructed, e.g., metal such as stainless steel or plastic such as PVC with or without a Teflon coating. Referring again to FIG. 5, plate members 28 may be shaped to resemble an upstanding oblong tab with leading edge/wall 32 extending upwardly and rearwardly from forward corner 34 of base edge 30 at angle θ of approximately 45 degrees in the present embodiment to plate peak 36. Leading edge/wall 32 connects with trailing or rear edge 38, which may be curved, and which extends downwardly rearwardly to rear corner 39 of base edge 30 so as to complete the shape of each of plates 28 in the present embodiment. Alternatively, other configurations, dimensions and orientations for the plate member 28 may be utilized depending upon the particular application.

With continued reference to FIG. 5, each vane member 24 may also include a cap 40 attached to the curved rear edge 38 of plate member 28. Each cap 40 may be generally triangular in shape, that is, cap 40 may have a narrow, i.e., pointed, front and widening wings extending therefrom. Cap 40 may also be somewhat rounded at the front end thereof and such configuration is encompassed by the term "generally triangular". Each cap 40 includes cap peak 42 from which side edge walls 44 outwardly rearwardly extend and form inner and outer surfaces 46 (shown in FIG. 3) and 48 (shown in FIG. 5), respectively. Generally, caps 40 may be fabricated in the flat and then bent to assume the curve shown in the drawings (for example following or conforming to the curved trailing edge), and may be attached by appropriate welding or adhesive techniques to trailing edge 38 of plate member 28. Alternatively, each entire vane 24 may be injection molded as a single, unitary piece in the case of engineered plastics, or laser printed, or forged, etc. when utilizing metals.

Figure 6:
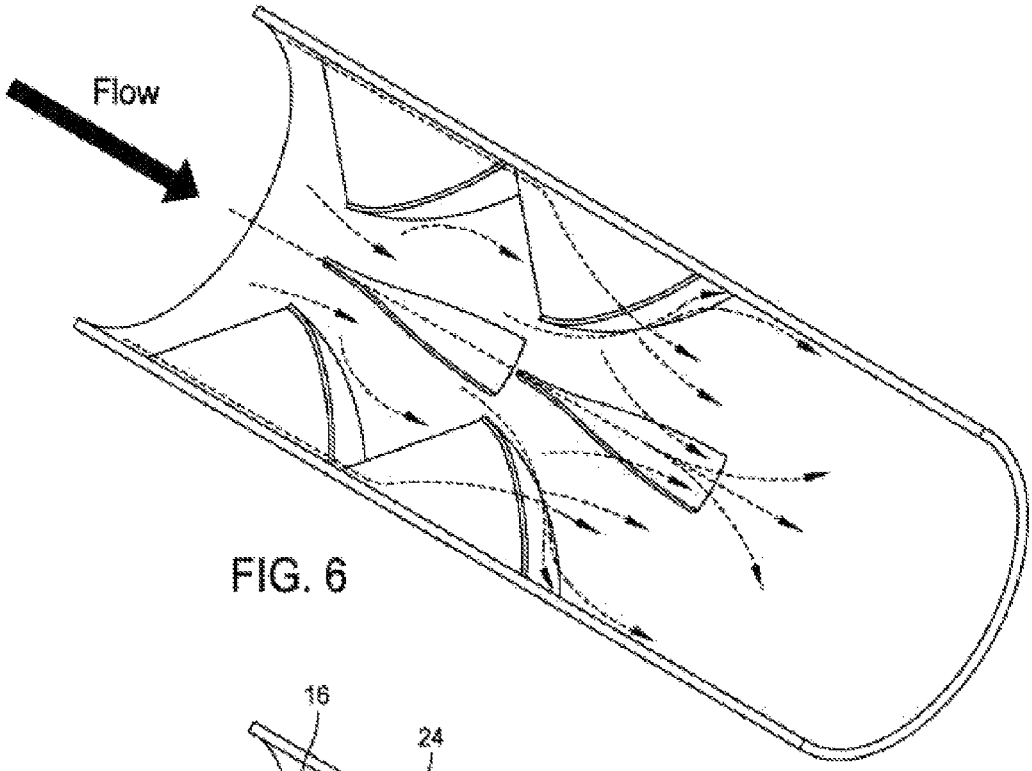
FIG. 6 is a perspective view of the mixing section of the static mixer of FIG. 1 showing the manner in which the fluid flow is diverted upon passing through the mixing section.
Figure 7:
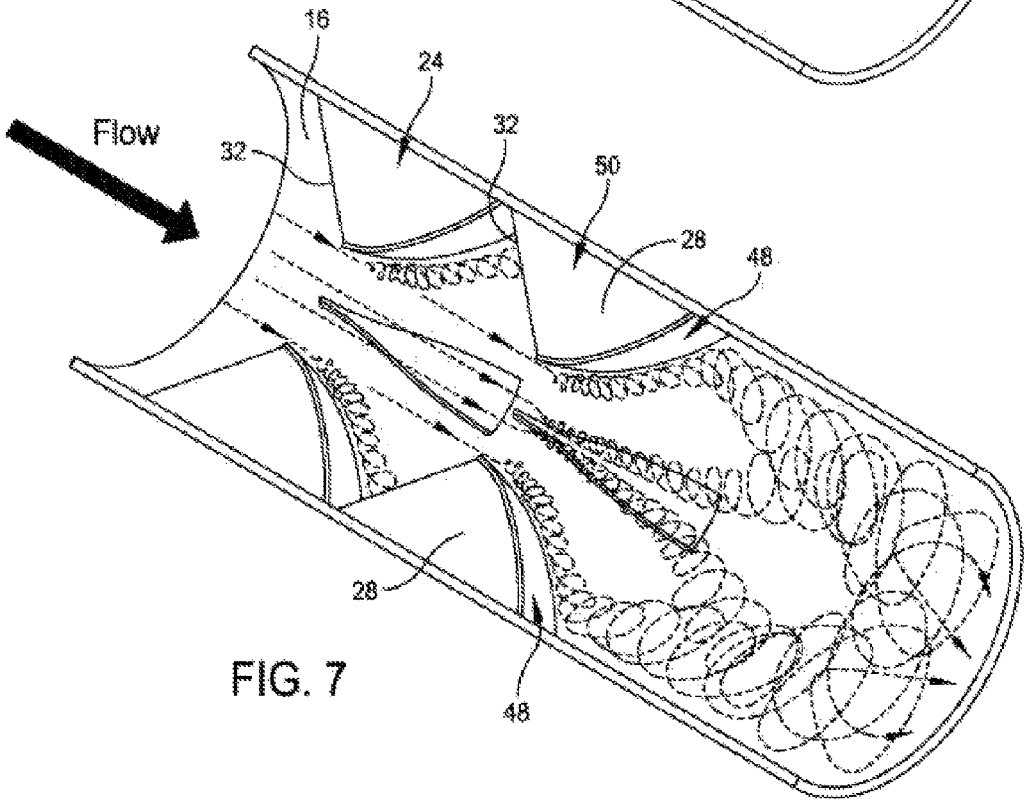
FIG. 7 is a perspective view of the mixing section of the static mixer of FIG. 1 showing the trailing vortices created by the static mixer upon the fluid flow passing through the mixing section.

Referring again to FIGS. 2 and 3, the above described combination of plate member 28 and cap 40 configuration supported within mixing section 14 provides a mixing system where fluid flowing within mixing device 10 initially encounters inlet section 12, then each plate forward edge 32 so as to be divided into eight (for a configuration assuming four vanes) streams. Thence each of such streams contacts the separate inner wall surfaces 46 of each of caps 40 and may be forced downwardly and outwardly into inner mixing wall surfaces 26 adjacent trailing end of mixer 10 (see FIG. 6). This action, in effect, turns these individual flow streams inside out and dissipates considerable energy from the flow. In addition, contact of the central stream undivided by the forward edges of vanes 24 creates strong trailing vortices (as shown in FIG. 7) that contribute to effective mixing action.

Referring to FIGS. 1 and 2, in the present embodiment, mixing section 14 further includes a set of vane members 50 downstream of vane members 24. Vane members 50 may be formed similarly to vane members 24 previously discussed. Vane members 50 divide the flow again causing a similar effect on the flow as vane members 24. Once so divided, the flow exits mixing device 10, for example via outlet conical section 16 in the present embodiment.

Figure 8:
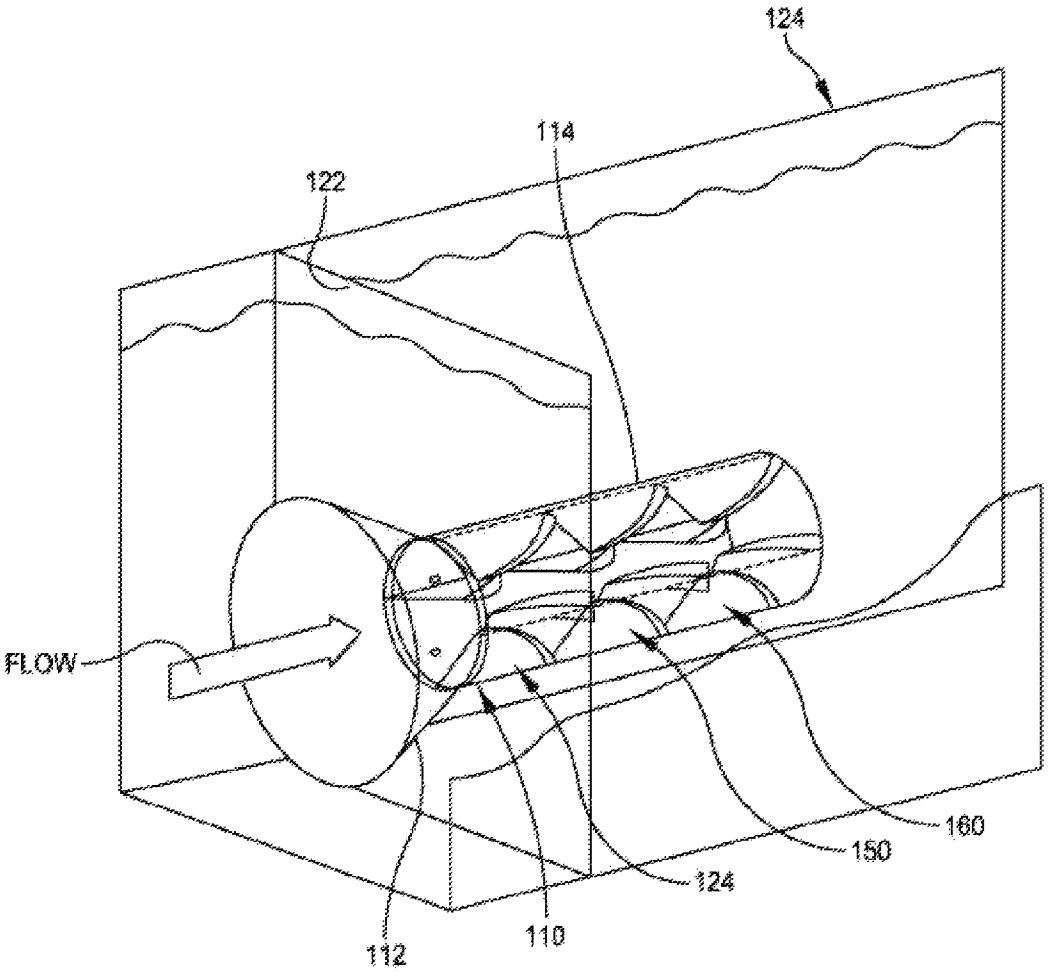
FIG. 8 is a schematic representation of a second exemplary static mixer having an inlet conical section and a mixing section but no outlet conical section.

Referring to FIG. 8, a second exemplary static mixer 110 is shown for open channel applications. Mixer 110 is similar to mixer 10 of FIG. 1, and as such the same or similar elements as the previous embodiment are labeled with the same reference numbers, preceded with the numeral "1". Mixer 110 includes inlet conical section 112 and mixing section 114 but does not include an outlet conical section (like outlet conical section 16 shown in FIG. 1). Pipe or mixing section 114 is similar to mixing section 14 (shown in FIG. 1) however, mixing section 114 includes a first set of vane members 124, a second set of vane members 150, and a third set of vane members 160. Vane members 124, 150 and 160 are formed similar to vane members 24 as previously described herein. In the present embodiment, adjacent sets of vane members 124, 150, 160 may be aligned with one another because offset orientation was found to somewhat inhibit mixing. However, offset orientation still produced acceptable results and may be used if so desired. In an alternative example, mixer 110 may include a varying number of sets of vane members other than three.

Figure 9:
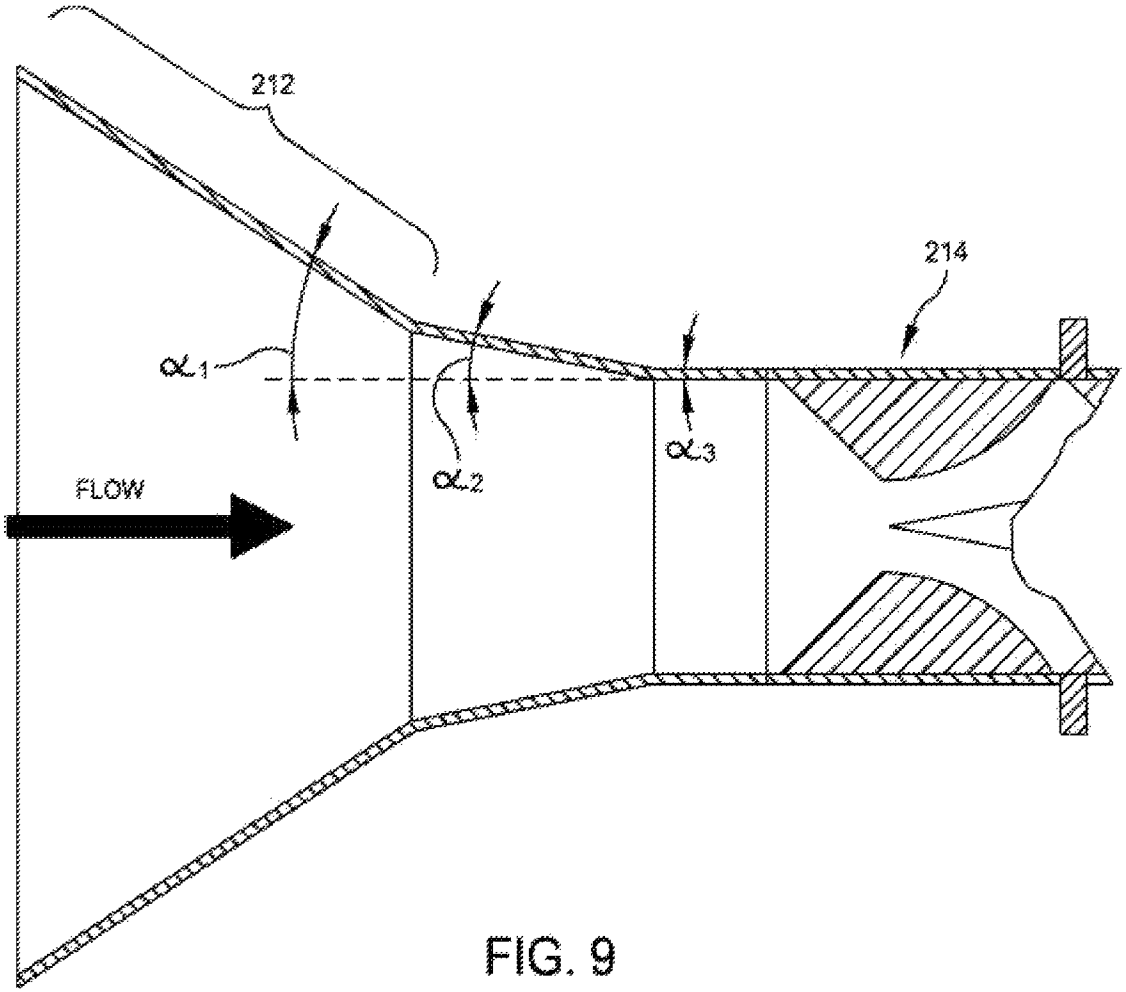
FIG. 9 is a schematic representation of a third exemplary static mixer with a multi-section inlet conical section and a mixing section.

Pressure loss may be additionally lowered and the inlet conical section length reduced, by using a multi-segment inlet conical section, for example a 3-segment inlet conical section with a non-uniform angle as shown in FIG. 9. The third exemplary embodiment of FIG. 9 is similar to mixer 10 of FIG. 1 and mixer 110 of FIG. 8, and as such the same or similar elements as the previous embodiment are labeled with the same reference numbers, preceded with the numeral "2". Mixer 210 includes multi-segment inlet conical section 212 and mixing section 214 but does not include an outlet conical section. Multi-segment inlet conical section 212 transitions from a first conical section 221 with a first angle $\alpha_1$, to a second conical section 223 with a second angle $\alpha_2$, then a third conical section 225 with a third angle $\alpha_3$. The first, second and third angles ($\alpha_1$, $\alpha_2$, $\alpha_3$) may all be different, with the first angle $\alpha_1$ being the largest. By way of non-limiting example, first conical section 221 may have an angle $\alpha_1$ of about 40°; second conical section 223 may have an angle $\alpha_2$ of about 7°; and third conical section 225 may have an may have an angle $\alpha_2$ of about 0° in the present embodiment.

Figure 10A:
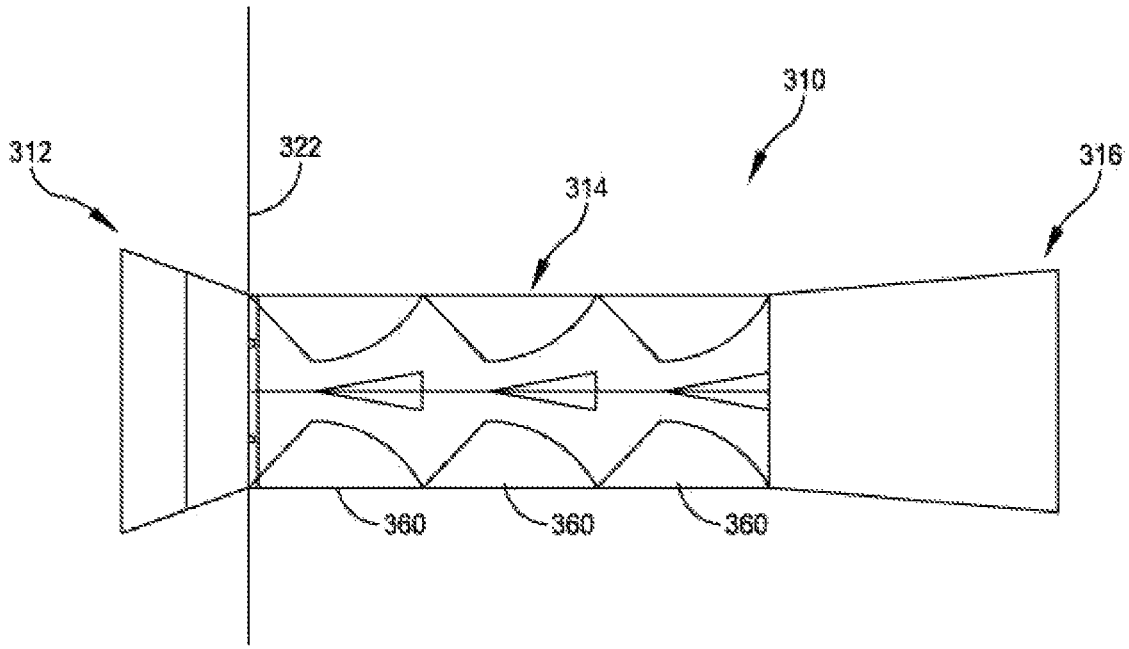
FIG. 10A is a schematic, perspective view of a fourth exemplary static mixer installed within an open channel.

Referring now to FIG. 10A, a fourth exemplary open channel mixer 310 is shown. Mixer 310 is similar to mixer 10 of FIG. 1 and mixer 110 of FIG. 8, and as such the same or similar elements as the previous embodiments are labeled with the same reference numbers, preceded with the numeral "3". Mixer 310 is similar to FIG. 1 in that it includes inlet conical section 312, mixing section 314, and outlet section 316. Mixing section 314 is similar to mixing section 114 (shown in FIG. 8) as it also includes three sets of vane members. In an alternative example, mixer 310 may include one or more sets of vane members.

In use, any of the static mixer embodiments described above many be utilized in open channel conditions where the water surface elevation can change significantly with flow rate, and this may be considered when designing the installation of the static mixer. The installation allows the downstream end of the mixer to be submerged under operating conditions, and the mixers may be selected with the capacity to pass the maximum required flow at the available head without overtopping the channel. However, the static mixers disclosed herein may find other applications as well and are not limited to use in open channels.

Installation of the static mixers within an open channel will now be described. In order to satisfy both low and high flow requirements that may be found in open channel applications, the mixer centerline may be located approximately 1.5 diameters above the channel floor. Also, provided the channel is wide enough, installing four 18" mixers rather than one 36" mixer should lower the minimum operable water level by approximately 3-ft, while maintaining the same maximum cross sectional mixer area, the same pressure loss, and the same maximum flow rate. The four mixers may be installed in one bulkhead or in multiple bulkheads. Although subsequent mixers may be aligned with one another in separate bulkheads instead of being offset because offset orientation may somewhat limit mixing, offset orientation can still produce acceptable results and may be used.

The static mixers 10, 110, 210 and 310 are designed to achieve a low coefficient of variation (CoV) (i.e., good mixing) of an injected fluid within a short distance with as little pressure loss as possible. Computational fluid dynamics (CFD) tests were conducted to determine the head loss and mixing capabilities of mixing device 310 in comparison with a mixing device 410, as described below. These results are not intended as limiting but rather are provided as examples of testing performed as described below.

Computational Model Description

The model geometry was developed using the commercially available three-dimensional CAD and mesh generation software, GAMBIT V2.4.6. The computational domain generated for the model consisted of approximately 4 million hexahedral and tetrahedral cells.

Numerical simulations were performed using the CFD software package FLUENT 13.1, a state-of-the-art, finite volume-based fluid flow simulation package including program modules for boundary condition specification, problem setup, and solution phases of a flow analysis. Advanced turbulence modeling techniques, improved solution convergence rates and special techniques for simulating species transport makes FLUENT are some of the reasons why FLUENT was chosen for use with the study.

FLUENT was used to calculate the three-dimensional, incompressible, turbulent flow through and around mixing device. A stochastic, two-equation k-model was used to simulate the turbulence. Detailed descriptions of the physical models employed in each of the Fluent modules are available from Ansys/Fluent, the developer of Fluent V13.1.

Model Boundary Conditions

Figure 11A:
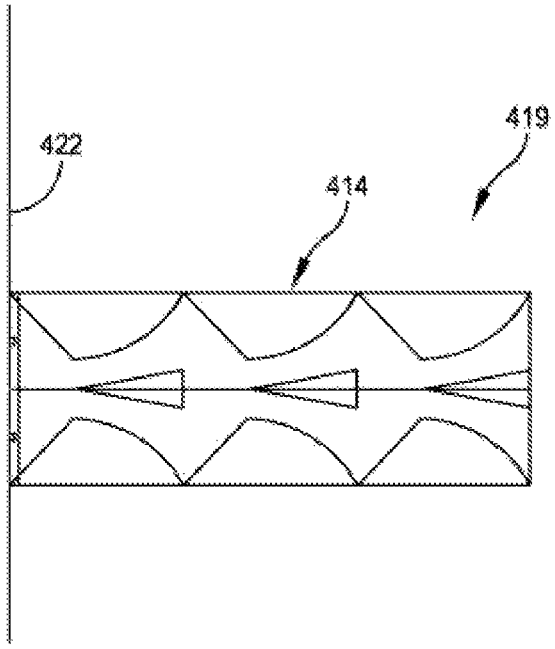
FIG. 11A is a schematic representation of a static mixer having three sets of vanes in the mixing section without an inlet or outlet conical section, mounted within an open channel for comparison testing.

The tests were conducted in 10-ft by 10-ft open channel similar to what would be used for chlorination of drinking water. Two 36" diameter mixer configurations 310, 410 (as shown in FIGS. 10A & 11A, respectively) were integrated into bulkheads 322, 422, respectively, across the channel that directs any water flowing down the channel through mixers 310, 410. The mixers' centerline was placed at the midpoint of the channel's span, and 4-ft off the channel floor. The mixing section length of the mixers was 8'-1.75", or 2.715 diameters. The model inlet was 10-ft upstream of the mixer bulkhead 422, and the outlet was 30-ft downstream of bulkhead 422. Mixer 310 includes conical inlet and diffuser outlet sections 312, 316 as well as mixing section 314.

It has been determined through previous testing that the static mixers perform similarly at different flow rates provided the flow is turbulent (Re>4,600), so only one water flow rate was tested. A uniform velocity was imposed at the model inlet, corresponding to 6,342 gpm (9.13 MGD) at a temperature of 60° F.

To measure mixing, a chlorine solution was injected into the mixer through two injection port locations at the mixer inlet plane, upstream of the 12 o'clock and the 6 o'clock mixer tabs or plate members. The solution was injected at a rate such that it would mix out to 982-ppm in the channel (6.23 gpm), though it is anticipated that it could be mixed at a much lower rate with similar results.

Referring to FIG. 10A, the conical inlet and diffuser outlet sections 312, 316 were utilized in order to reduce the head loss of mixer 310 at a given flow rate, or to increase the flow rate at a given head loss. In the present, non-limiting example, the inlet conical section 312 is 2'-0" (0.667 D) long with an included angle of 40°. In the present, non-limiting example, the outlet conical section 316 is 4'-6" (1.5 D) long with an included angle of 10°.

Mixers 310 and 410 were analyzed with the inlet of 310 and inlet of mixing section 416, respectively, flush with bulkheads 322 and 422, respectively. However, to avoid overhung loads on bulkheads 322, 422, mixers 310, 410 may be installed so that their center of gravity is in the bulkhead plane for a better structural design, and ease of installation/recovery of the mixer. Moving the mixer forward in the bulkhead should not change the pressure loss across mixer 310 with inlet and diffuser, and should slightly increase the pressure loss across mixer 410.

Results and Discussion

The pressure loss across each of the mixer configurations 310, 410 was calculated in the CFD model at the specified flow rate, and a loss coefficient (k-value) was calculated (Table 1), where the k-value is defined using consistent units:

$$k = \frac{\Delta p}{\frac{1}{2}\rho V^2}$$

Figure 13:
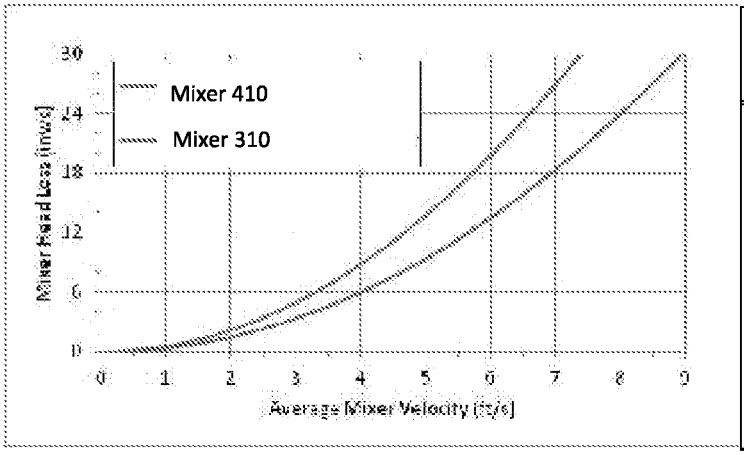
FIG. 13 is a Graph "A" showing head loss of two exemplary mixers.

Once the mixer loss coefficient (k-value) is calculated, predictions of the mixer pressure loss can be made across the expected flow range (FIG. 13).

TABLE 1

Flow Results and Computation of k-value for Mixers 310, 410

| Flow Results: | Units | Mixer 410 | Mixer 310 |
|---|---|---|---|
| Mixer Diameter | (in) | 36.0 | 36.0 |
| Water Flow Rate | (gpm) | 6,342 | 6,342 |
| Dosing Flow Rate | (gpm) | 6.23 | 6.23 |
| Average Mixer Velocity | (ft/s) | 2.00 | 2.00 |
| Water Density | (pcf) | 62.4 | 62.4 |
| Mixer Head Loss | (inwc) | 2.20 | 1.50 |
| Mixer k-value | | 2.95 | 2.01 |

FIG. 13 shows that the inlet and diffuser conical sections were found to reduce the mixer pressure loss of mixer 310 by 32% at a given flow rate, or increase flow rate by 18% at a given head loss. Of the decrease in pressure loss in mixer 310, 52% is attributable to the inlet conical section, and 48% is attributable to the diffuser or outlet conical section.

Mixing performance was evaluated at the model outlet, which is a plane across the channel 30-ft downstream of the mixer bulkheads 322, 422. The results are presented in Table 2.

TABLE 2

| Mixing Results 30-ft Downstream of the Bulkhead | | | |
|---|---|---|---|
| Mixing Results: | Units | Mixer 410 | Mixer 310 |
| Average Volume Fraction | (ppm) | 982 | 982 |
| Minimum Volume Fraction | (ppm) | 6,977 | 946 |
| Maximum Volume Fraction | (ppm) | 1,000 | 1,031 |
| Standard Deviation | (ppm) | 8 | 18 |
| Coefficient of Variation (CoV) | | 0.008 | 0.018 |

With reference to FIGS. 10A and 11A together with Table 2, both mixers 310, 410 offer excellent mixing performance, with very low CoV values ten mixer diameters (30-ft) downstream of the bulkheads 322, 422, respectively. The mixing in mixer 410 (without the inlet and diffuser) with CoV=0.008 is better that mixing in mixer 310 (with inlet and diffuser) with CoV=0.018.

As will be appreciated from the results, a significant amount of mixing occurs at the outlet of the mixers where the high velocity swirling flow exiting the mixer interacts with the bulk flow on the downstream side of bulkhead 322, 422. This is why mixer 310 with the diffuser has a higher CoV; the diffuser reduces energy loss of the flow through mixer 310 by limiting the turbulent momentum transfer with the bulk fluid as it slows and expands the flow, however this also reduces the energy available for mixing once the flow exits the diffuser 316.

The mixers 310 and 410 were shown to work very well as an open channel mixer in either configuration tested. The low-pressure loss characteristics are desirable for pressure limited operation, and the raked angle Θ in FIG. 5 prevent fouling. Also, the mixer tabs or plate member 28 (of FIG. 5) operate to break up any swirling flow, which at high velocities or low submergence depths could cause air-entraining vortices to form, which would reduce flow rate.

Mixer 110 (shown in FIG. 8) with only an inlet conical section and without a diffuser conical section, was also found to have the same mixing performance of mixer 410 (CoV=0.008), but with a pressure loss (k=2.50) approximately halfway between mixers 310 and 410. Performance of each of models 110, 310, and 410 are summarized in Table 3 below.

TABLE 3

| Summary of Head Loss and Mixing Performance | | | |
|---|---|---|---|
| Summary | Mixer 110 | Mixer 410 | Mixer 310 |
| k-value | 2.5 | 2.95 | 2.0 |
| Coefficient of Variation (CoV) | 0.008 | 0.008 | 0.018 |

Too much head loss can result in overflow upstream from the mixing device, which is why minimizing head loss is desirable. In addition, if there is too much obstruction or head loss flooding may also occur. Head loss plays more of a roll in open channel applications because it can cause flooding, where in non-open channel applications low head loss results in optimal mixing with low pump energy (i.e., less cost).

Figure 10B:
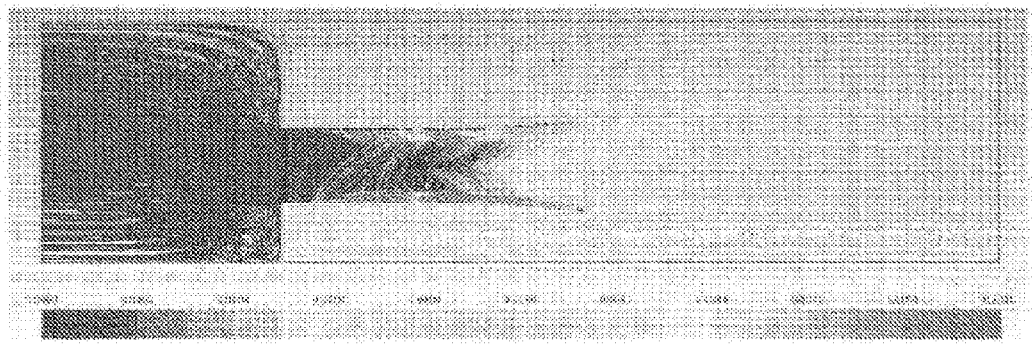
FIG. 10B is a diagram showing the flow conditions during modeling of the static mixer of FIG. 10A.
Figure 11B:
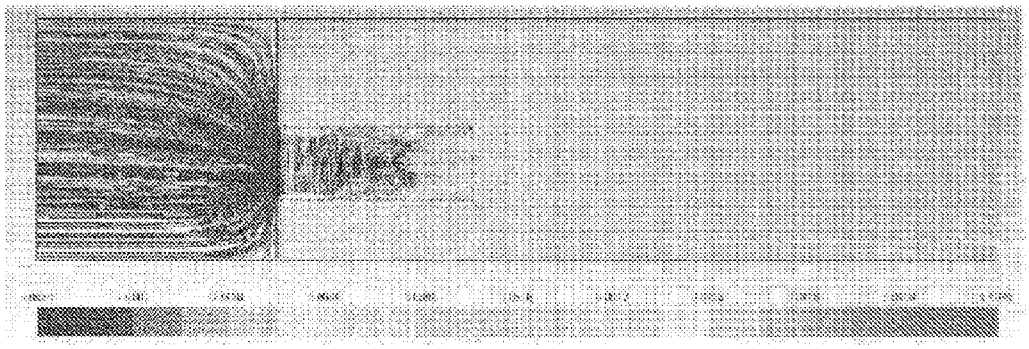
FIG. 11B is a diagram showing the flow conditions during modeling of the mixer of FIG. 9.

Mixer 310 provides optimal pressure loss reduction (See Table 3. K=2.0, CoV=0.018). The inlet and diffuser conical sections of mixer 310 reduced mixer pressure loss by 32% at a given flow rate, or increased flow rate by 18% at a given head loss. The diffuser reduces energy loss of the flow through the mixer by limiting the turbulent momentum transfer with the bulk fluid as it slows and expands the flow. This reduces the energy available for mixing once the flow exits the diffuser. Without the inlet conical section, pressure loss is greater as there is a large separated flow region at the walls in the first stage of the mixer 410 (shown in FIG. 11B); whereas with the inlet conical section, the flow remains attached to wall of mixer 310 (shown in FIG. 10B) throughout. The K value using inlet and diffuser conical sections is 2.0. Mixing results of mixer 310 was still excellent (CoV=0.018), though marginally less efficient than mixing the mixer 410 without the conical sections (CoV=0.008).

Mixer 110 provided superior mixing (See Table 3. K=2.5, CoV=0.008). In settings where the best possible mixing is required, mixer 410 without inlet and diffuser conical sections has been found to be the most effective mixing (i.e., CoV). Mixer 410 may be selected if mixing is more important than reducing pressure loss. Both mixers 310, 410 offer excellent mixing performance, with very low CoV values ten mixer diameters downstream of the bulkhead (30-ft). However, mixer 410 without inlet and diffuser has a CoV=0.008, which is better than the mixer 310 with the inlet and diffuser which has a CoV=0.018. The K value of mixer 410 without the conical sections is 2.95. Thus, pressure loss is not optimized.

Mixer 110 balances mixing and pressure Loss (See Table 3. K=2.5, CoV=0.008). Where a balance of mixing efficiency and reduced pressure loss is desired, mixer 110 with inlet conical section but without the diffuser may be used. Mixer 110 would have mixing performance similar to mixer 410, offering the best of both parameters. The K value for mixer 110 (with an inlet conical section) is 2.5.

The open channel mixers 10, 110, 210, and 310 as disclosed herein provide excellent mixing and low permanent pressure loss, as detailed above. These mixers also have no moving parts that require electricity and thus, no power consumption. As a result, significant savings can be realized on the installation, operation and maintenance of these mixers. Using less energy is also good for the environment. Furthermore, these mixers are self-contained and can be removed as needed without the cost associated with more permanent open-channel installations. Since the mixers are self-contained they are also easy to mount, lightweight compared to other open channel mixers, and less expensive to manufacture. In addition to the foregoing, since the pressure loss coefficient of the mixers is known, mixers 10, 110, 210 and 310 may also be used for flow rate indication by measuring the water surface elevation difference across the mixer. This is assuming the bulkhead is sealed adequately to the channel walls. Additional features of these mixers include the following: they accommodate changing water levels and flow rates, resist fouling, are suitable for remote locations, have a short laying length, minimal maintenance is needed, and they have an anticipated long service life.

Those skilled in the art will appreciate that the conception, upon which this disclosure is based, may readily be utilized as a basis for designing other products. Therefore, the claims are not to be limited to the specific examples depicted herein. For example, the features of one example disclosed above can be used with the features of another example. Furthermore, various modifications and rearrangements of the parts may be made without departing from the spirit and scope of the underlying inventive concept and that the same is not limited to the particular forms herein shown and described except insofar as indicated by the scope of the appended claims. For example, the geometric configurations disclosed herein may be altered depending upon the application, as may the material selection for the components. Thus, the details of these components as set forth in the above-described examples, should not limit the scope of the claims.

Further, the purpose of the Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the claims of the application nor is intended to be limiting on the claims in any way.

The invention claimed is:

1. A static mixing device for mixing fluids comprising:

at least one conical section having a tapered configuration;

a mixing section including at least a first set of vane members, each set including at least two vane members, each of the at least two vane members being supported by and extending radially from an internal wall surface of the mixing section and wherein each of the at least two vane members includes a plate member with a base edge that is secured to the internal wall surface of the mixing section, the plate member including an upstanding oblong tab with a leading edge extending upwardly and rearwardly from a forward corner of the base edge to a plate peak, the leading edge connecting with a curved trailing edge, the trailing edge extending downwardly and rearwardly to a rear corner of the base edge so as to complete the shape of each plate member to promote mixing of the fluids within the mixing section;

a longitudinally extending flow path defined by the at least one conical section and the mixing section, the flow path guiding the fluids during operation through the mixing device; and wherein the at least one conical section is an inlet conical section disposed upstream of the mixing section and constructed and arranged to reduce the pressure loss in the static mixing device by smoothing the flow of fluid entering the mixing section.

2. The static mixing device of claim 1, wherein the inlet conical section has a converging geometry constructed and arranged to reduce pressure loss by lessening separated flow regions at the internal wall surface in a first stage of the mixer.

3. The static mixing device of claim 2, wherein the at least one conical section further includes an outlet conical section disposed downstream of the mixing section.

4. The static mixing device of claim 3, wherein the outlet conical section has a diverging geometry.

5. The static mixing device of claim 3, wherein the inlet conical section forms an angle with the internal wall of the mixing section, and the outlet conical section forms an angle with the internal wall of the mixing section, the angle of the inlet conical section being greater than the angle of the outlet conical section.

6. The static mixing device of claim 3, wherein the inlet conical section forms an angle with the internal wall of the mixing section, and the outlet conical section forms an angle with the internal wall of the mixing section, the angle of the inlet conical section being equal to the angle of the outlet conical section.

7. The static mixing device of claim 1, further comprising a circumferentially extending flange supported on an exterior surface of the mixing section, the flange being constructed and arranged to secure the mixing device to a bulkhead disposed in an open channel containing a moving fluid.

8. The static mixing device of claim 1, wherein the at least first set of vane members includes at least four vane members.

9. The static mixing device of claim 1, wherein the at least first set of vane members includes a first set of vane members and a second set of vane members positioned downstream of the first set of vane members.

10. The static mixing device of claim 9, wherein the at least first set of vane members further includes a third set of vane members positioned downstream of the second set of vane members.

11. The static mixing device of claim 1, wherein the inlet conical section includes multiple segments, each one of the multiple segments having a different included angle.

12. A static mixing device for mixing fluids comprising:

at least one conical section having a tapered configuration;

a mixing section including at least a first set of vane members, each set including at least two vane members, each of the vane members being supported by and extending radially from an internal wall surface of the mixing section and wherein each of the at least two vane members includes a plate member with a base edge that is secured to the internal wall surface of the mixing section, the plate member including an upstanding oblong tab with a leading edge extending upwardly and rearwardly from a forward corner of the base edge to a plate peak, the leading edge connecting with a curved trailing edge, the trailing edge extending downwardly and rearwardly to a rear corner of the base edge so as to complete the shape of each plate member to promote mixing of the fluids within the mixing section;

a longitudinally extending flow path defined by the at least one conical section and the mixing section, the path guiding the fluid during operation through the mixing device; and wherein the at least one conical section is an outlet conical section supported downstream of the mixing section and having a first, proximal end and a second, distal end supported by the mixing section, the outlet conical section diverging from the proximal end to the distal end and being constructed and arranged to reduce energy loss of flow through the static mixer by limiting the turbulent momentum transfer of the fluid.

13. The static mixing device of claim 12, wherein the at least one conical section further includes an inlet conical section supported by the mixing section upstream.

14. The static mixing device of claim 13, wherein the inlet conical section has a geometry converging from the proximal end to the distal end.

15. The static mixing device of claim 14, wherein the inlet conical section forms an angle with the internal wall of the mixing section, and the outlet conical section forms an angle with the internal wall of the mixing section, the angle of the inlet conical section being greater than the angle of the outlet conical section.

16. The static mixing device of claim 14, wherein the inlet conical section forms an angle with the internal wall of the mixing section, and the outlet conical section forms an angle with the internal wall of the mixing section, the angle of the inlet conical section being equal to the angle of the outlet conical section.

17. The static mixing device of claim 12, further comprising a circumferentially extending flange supported on an exterior surface of the mixing section, the flange being constructed and arranged to secure the mixing device to a bulkhead disposed in an open channel containing a moving fluid.

18. The static mixing device of claim 12, wherein the at least first set of vane members includes four vane members.

19. The static mixing device of claim 12, wherein the at least first set of vane members includes a first set of vane members and a second set of vane members positioned downstream of the first set of vane members.

20. The static mixing device of claim 19, wherein the at least first set of vane members further includes a third set of vane members positioned downstream of the second set of vane members.

21. The static mixing device of claim 14, wherein the inlet conical section includes multiple segments, each segment having different included angles.

22. A static mixing device for mixing fluids comprising:

a mixing section, the mixing section including at least a first set of vane members, each set including at least two vane members, each of the at least two vane members being supported by an internal wall surface of the mixing section and spaced generally circumferentially within the mixing section and extending radially inwardly from the inner wall surface of the mixing towards the center of the mixing section and wherein each of the at least two vane members includes a plate member with a base edge that is secured to the internal wall surface of the mixing section, the plate member including an upstanding oblong tab with a leading edge extending upwardly and rearwardly from a forward corner of the base edge to a plate peak, the leading edge connecting with a curved trailing edge, the trailing edge extending downwardly and rearwardly to a rear corner of the base edge so as to complete the shape of each plate member;

an inlet conical section supported upstream of the mixing section and having a first, proximal end and a second, distal end supported by the mixing section, the inlet conical section converging from the proximal end to the distal end;

an outlet conical section supported downsteam of the mixing section and having a first, proximal end and a second, distal end supported by the mixing section, the outlet conical section diverging from the proximal end to the distal end;

a longitudinally extending flow path defined by the inlet conical section, the outlet conical section and the mixing section, the path guiding the fluid during operation through the mixing device; and wherein the inlet conical section is constructed and arranged to reduce the pressure loss in the static mixing device by smoothing the flow of fluid entering the mixing section and wherein the outlet conical section is constructed and arranged to reduce energy loss of flow through the static mixer by limiting the turbulent momentum transfer of the fluid.

23. The static mixing device of claim 22, wherein each of the at least two vane members includes a generally triangularly-shaped cap conforming to a curved trailing edge.

* * * * *